US005277618A

United States Patent [19]

Mitra

[11] Patent Number: 5,277,618

[45] Date of Patent: Jan. 11, 1994

[54] CONNECTOR HAVING FIXING MEANS FOR MOUNTING ON A SUBSTRATE

[75] Inventor: Niranjan K. Mitra, Eindhoven, Netherlands

[73] Assignee: E. I. du Pont Nemours and Company, Wilmington, Del.

[21] Appl. No.: 939,862

[22] Filed: Sep. 14, 1992

Related U.S. Application Data

[63] Continuation of Ser. No. 875,475, Apr. 29, 1992, abandoned.

[30] Foreign Application Priority Data

May 2, 1991 [NL] Netherlands ..... 9100760

[51] Int. Cl.[5] ..... H01R 13/00

[52] U.S. Cl. ..... 439/564; 439/573

[58] Field of Search ..... 439/62, 76, 527, 547, 439/554, 555, 560, 564, 566, 571–573

[56] References Cited

U.S. PATENT DOCUMENTS

| | | | |
|---|---|---|---|
| 4,195,900 | 4/1980 | Hughes | 439/573 |
| 4,435,031 | 3/1984 | Black et al. | 339/17 C |
| 4,583,807 | 4/1986 | Kaufman et al. | 439/573 |
| 4,645,277 | 2/1987 | Kikuchi et al. | 339/17 LM |
| 4,679,883 | 7/1987 | Assini et al. | 439/573 |
| 4,710,132 | 12/1987 | Glomb et al. | 439/79 |
| 4,824,387 | 4/1989 | de Jong et al. | 439/248 |
| 4,936,786 | 6/1990 | Klein et al. | 439/80 |
| 5,037,327 | 8/1991 | Van Woensel | 439/571 |

FOREIGN PATENT DOCUMENTS

| | | |
|---|---|---|
| 8900212 | 8/1990 | Netherlands . |
| 1034236 | 6/1966 | United Kingdom . |
| 1152767 | 5/1969 | United Kingdom . |
| 1187555 | 4/1970 | United Kingdom . |
| 1394623 | 5/1975 | United Kingdom . |

*Primary Examiner*—Joseph H. McGlynn

*Attorney, Agent, or Firm*—Woodcock Washburn Kurtz Mackiewicz & Norris

[57] ABSTRACT

Connector (1, 11, 24, 26, 36, 40) for mounting on a substrate (2, 14, 23, 25, 35, 46) comprising one or more contact elements (13, 28, 29, 37, 44) accommodated in a housing (3, 12, 41), having a mounting side (19, 32, 39), which, in the mounted state of the connector (1, 11, 24, 26, 36, 40) is situated opposite a face of the substrate (2, 14, 23, 25, 35, 46). The fixing means of the connector (1, 11, 24, 26, 36, 40) consist of at least one element, projecting outside the housing (3, 12, 41) beyond the mounting side (19, 32, 39) and connected thereto, preferably a pin-type element (7, 47) for engaging in an opening (8, 48) of the substrate (2, 14, 23, 25, 35, 46). The at least one element (7, 47) is disposed so as to be displaced outwards from a wall (9; 15, 16; 38; 42, 43) of the housing (3, 12, 41), which wall (9; 15, 16; 38; 42, 43) adjoins the mounting side (19, 32, 39). The at least one fixing element (7, 47) can also be used for positioning and polarising purposes. A housing (3, 12, 41) provided with such fixing elements (7, 47) is suitable, in particular, for connectors (1, 11, 24, 26, 36, 40) having a pitch distance of 1.27 mm or less.

4 Claims, 2 Drawing Sheets

CONNECTOR HAVING FIXING MEANS FOR MOUNTING ON A SUBSTRATE

This is a continuation, of application Ser. No. 875,475, filed Apr. 29, 1992, now abandoned.

BACKGROUND OF THE INVENTION

The invention relates to a connector having fixing means for mounting on a substrate, comprising one or more contact elements of electrically conducting material accommodated in a housing constructed from walls made of electrically insulating material, having a mounting side which, in the mounted state of the connector, is situated opposite a face of the substrate, the fixing means consisting of at least one element, projecting outside the housing beyond the mounting side and connected thereto, for engaging in an opening of the substrate.

A connector is shown having fixing means, for example, in U.S. Pat. No. 5,037,327 assigned to the assignee of the present application. The fixing means therein consist of metal elements accommodated in one or more walls of the housing. To position the connector on the substrate, the housing is provided on the mounting side with outwardly projecting positioning projections.

In view of the current trend towards scale reduction of electronic components in order, on the one hand, to manufacture as small equipment as possible, which is suitable for insulation, and, on the other hand, in order to accommodate as many components as possible in equipment of given dimensions, for example in order to increase the number of functions of the equipment concerned, there is an increasing need for connectors of reduced dimension and/or connectors having as high a number of contact elements as possible without increasing the dimensions of the connector itself. Apart from, or in addition to, the use of suitably dimensioned contact elements, a reduction of the dimensions of the connector can also be achieved by constructing the walls of the housing with as little thickness as possible. However, this has consequences for accommodating a fixing element in these walls in accordance with the aforenoted U.S. Pat. No. 5,037,327. In order to achieve a mechanically adequate, rigid fixing, the fixing element should, after all, have a certain minimum thickness. Consequently, this method of fixing cannot be used in a housing having walls thinner than this minimum thickness.

SUMMARY OF THE INVENTION

The invention is therefore based on the object of providing a connector with fixing means for mounting on a substrate such as a printed circuit board, which fixing means are such that a mutual pitch distance of the contact elements of less than or equal to 1.27 mm becomes possible without the fixing means substantially or adversely affecting the external dimensions of the connector in the mounted state.

According to the invention, this is achieved in a manner such that at least one element for fixing the connector is disposed so as to be displaced outwards from the face of a wall of the housing, which wall adjoins the mounting side, and is formed as an integrated part from the material of the walls of the housing.

As a result of displacing the disposition of the at least one element for fixing the connector as much as possible towards the circumference of the housing, the contact elements of the latter can be arranged as close to one another as their dimensions permit or as is required to provide a connector of a certain pitch distance, if desired in row and/or column form, having connection ends projecting outwards from the mounting side. After all, no, or only a small amount of, space needs to be reserved at the mounting side for fixing elements projecting outwards therefrom between adjacent connection ends, which otherwise would result, with the intended reduced dimensions of the connector, in undesirable loss of position of one or more contact elements.

Apart from this space-saving or contact-position-saving disposition of the at least one element for fixing the connector according to the invention, this disposition furthermore has the advantage that the housing can absorb higher mechanical forces at the boundary of the mounting side and a further wall connecting thereto than, for example, in the centre of a relatively thin boundary wall between contact elements.

Concomitantly dependent on the cross-sectional dimensions of the at least one element for fixing the connector according to the invention and the material from which the latter is manufactured, it is also of advantage for the mechanical rigidity to arrange for the element concerned to extend over a distance along the associated wall, adjoining the mounting side, of the housing.

In a further embodiment of the connector according to the invention in which the at least one element extends from the mounting side over a portion of the respective adjoining wall of the housing, the portion, terminating in the wall, of the at least one element also forms a stop for a further connector to be coupled to the connector concerned, for example a further connector which, in the contacted state, encloses a portion of the housing of the connector first mentioned.

If, because of the shape of a respective connector, of a further connector to be coupled thereto or for mounting on a specific substrate, the mounting side of the connector should have, in the mounted state, a certain spacing from the oppositely situated surface of the substrate, in yet a further embodiment of the connector according to the invention, the at least one element is provided with a portion displaced outwards from the face of the mounting side, which portion extends, when the connector is mounted on a substrate surface, as a spacing piece between the housing and the respective surface of the substrate.

The use of separate spacing pieces or the provision of protruding edge parts at the underside of the housing is superfluous in a connector constructed in accordance with this embodiment.

In yet another embodiment of the connector according to the invention, which is suitable for the adjoining mounting of connectors, without loss of a position, for the purpose of providing an assembled, extended connector, and in which the housing comprises one or more side walls adjoining the mounting side in the longitudinal direction, a plurality of elements for fixing the connector, which elements are situated in a displaced manner in the longitudinal direction, are formed at at least one side wall.

Such a connector having fixing elements situated at one side wall is both suitable for disposing a similar further connector so as to adjoin the oppositely situated side wall and/or mounting a further connector at the adjoining ends. In the English-language specialist literature, this is also described as "stacking". A connector with fixing elements at both side walls is, of course, only "end-to-end stackable". This latter is the most used in practice.

The invention is suitable, in particular, for connectors provided with contact elements having connection ends for what is known in the English-language specialist literature as "surface mounting". The contact faces of the connection ends, which are of a construction to some extent resilient per se, should, after all, be fixed with a certain pressure on the face of a substrate to be contacted to achieve a reliable connection. In order to achieve the contact pressure needed for the surface mounting over the entire length of a connector concerned, the invention further provides a connector having connection ends for surface mounting projecting outside the housing from the mounting side at at least one side wall, the elements for fixing the connector extending over a distance less than the connection ends beyond a respective side wall.

With fixing elements arranged in this way, the connector is secured, in the mounted state, against the substrate over its entire length and the necessary contact pressure for the connector is achieved without the effective external dimensions of the housing being adversely affected thereby. This type of connector is eminently suitable for surface mounting in which the connection ends concerned are connected by means of electrically conducting adhesive to corresponding connection areas of a substrate.

As already mentioned above, the connector shown in U.S. Pat. No. 5,037,327 has positioning protrusions projecting from the mounting side. In the case of connectors of reduced dimensions there can be no room available in the bottom face, on the one hand, for this positioning protrusions and/or the wall of the mounting side forms a mechanically inadequately strong supporting surface as a result of its small thickness. It has been realised that the fixing elements according to the invention can also be used for positioning and polarisation purposes. In an embodiment of the connector according to the invention based on this realisation, the elements for fixing the connector are arranged for this purpose according to a particular pattern. By arranging the openings in the substrate for accommodating the fixing elements according to a similar pattern, it is possible to prevent connectors having fixing elements arranged according to a pattern which differs from the pattern of the openings in the substrate from being capable of being mounted thereon. When the connector is being positioned, the fixing elements may also fulfil a sensing function. This is especially advantageous when assembly robots or the like are used.

Because the fixing elements are situated outside the circumference of one or more walls of the housing, they can be used not only as a stop but also as polarising protrusions for a further connector to be contacted, in particular a further connector provided with corresponding polarising openings or grooves which partially encloses the housing and the fixing elements in the contacted state. If desired, the fixing elements may project outwards beyond the side of the connector for contacting a further connector in order to be accommodated in corresponding polarisation openings or grooves in this further connector. By mutually varying the distance between the elements and their position with respect to the housing, a multiplicity of unique coding patterns can be provided.

Another method which can be used for the automatic prevention of undesired connections or in combination with the disposition of the fixing elements in a pattern is, according to an embodiment of the invention, that in which the at least one element for fixing the connector has a particular cross section in terms of shape and dimension which is such that fixing elements having a cross section differing from a respective opening in the substrate or further connector cannot engage therein. Circular and polygonal structures are known per se for this purpose in practice.

In the preferred embodiment of the connector according to the invention, the at least one element for fixing the connector extends outside the housing beyond the mounting side over a distance which is such that, on engaging in a corresponding opening of a substrate, a portion of the element concerned extends outside the substrate for fixing the housing to the substrate by upsetting the projecting portion.

Plastic fixing elements may advantageously be upset ultrasonically because this entails the least thermal stress for the substrate. Any thermal upsetting technique can, of course, be used per se for fixing the connector.

Although upsetting is preferred because it is possible to work with a loose fit of the fixing elements and the corresponding openings in the substrate in this case without an undesirable force-increasing effect on the mounting of the connector, yet a further embodiment provides that the at least one element for fixing the connector is provided with means for locking engagement in a corresponding opening of the substrate. Although a greater force is necessary for mounting such a connector than for the embodiment with loose fitting, self-locking fixing devices have the advantage that no additional aids such as those for upsetting the fixing elements are necessary. Self-locking fixing elements can moreover be formed in a manner such that a mounted connector can be removed for reuse or repair without damage. Suitable locking means for this purpose are generally known in practice.

The fixing element is preferably a pin, formed on the housing, whose position can correspond, in the manufacture of the housing by injection moulding of plastic, to an injection opening for injecting plastic material into a mould.

It is pointed out that, while retaining a large number of the the advantages, the invention can also be used per se in the case of connectors having a pitch distance between the contact elements which is greater than the pitch distance of 1.27 mm mentioned above.

The invention is explained in more detail below with reference to a number of exemplary embodiments shown in the drawing.

DETAILED DESCRIPTION OF THE EMBODIMENTS

Figure 1:
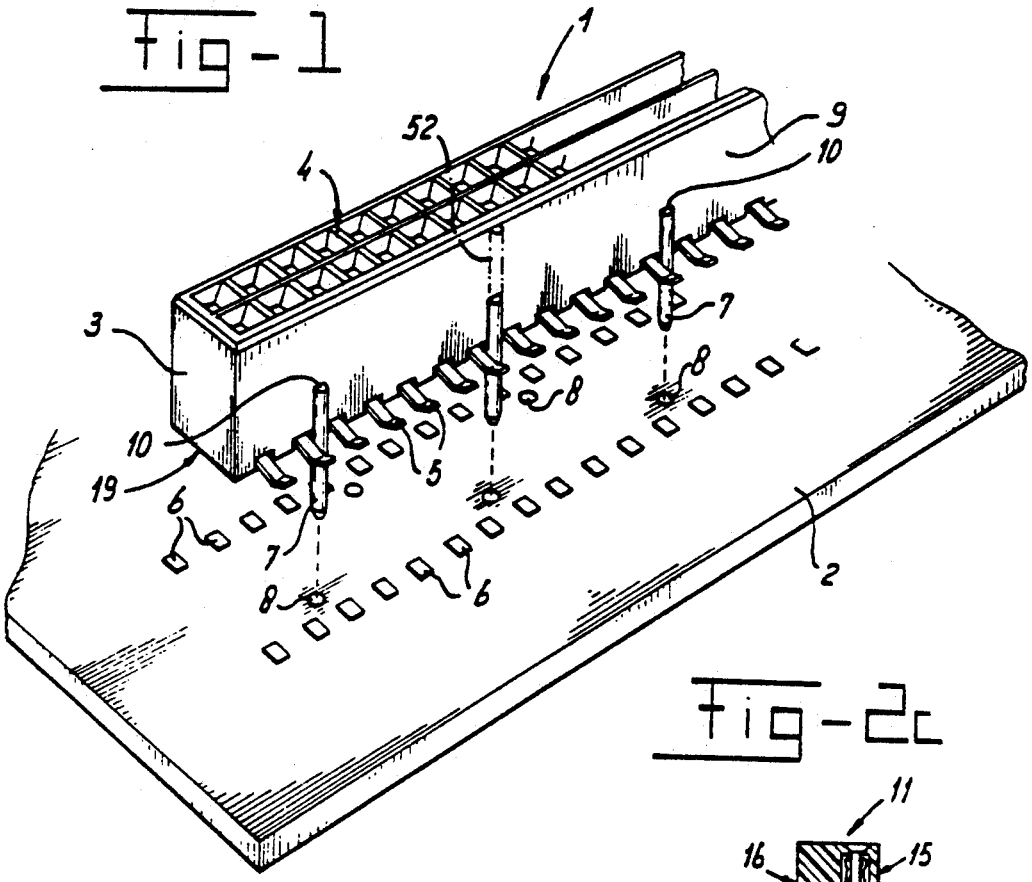
FIG. 1 diagrammatically shows, in perspective, a portion of a connector for surface mounting provided with fixing elements according to the invention.

FIG. 1 shows a connector 1 for surface mounting on a substrate 2, for example a printed circuit board, an LCD display or the like. The connector 1 is provided with a housing 3 made of electrically insulating material such as plastic, having a contact side 4 for contacting a further connector and having a connection or mounting side from which there extend connection ends 5 of contact elements accommodated in the housing 3 and made of electrically conducting material (not shown). For connecting the contact elements, the substrate 2 is provided with connection areas 6 whose position corresponds to the position of the connection ends 5 of the connector 1. Although not shown for the sake of simplicity, the connection areas 6 are connected, in the case of, for example, a printed circuit board, to electrical and/or electronic components mounted, or to be mounted, on the substrate via electrically conducting tracks.

According to the invention, the housing 3 is provided with pin-type fixing elements 7 and the substrate 2 has correspondingly situated openings 8 in which the fixing elements 7 engage in the state where the connector 1 is mounted on the substrate.

It can be seen that the fixing elements 7 are disposed so as to be displaced outwards from the face of a long side wall 9 of the housing and project outside the housing 3 of the connector 1 at the mounting side. The portion of the fixing elements 7 which extends over the long side wall 9 of the housing 3 forms a stop 10 for a further connector to be contacted with the connector 1.

Figure 2C:
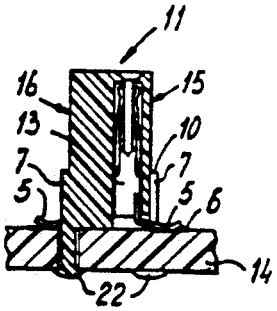
FIGS. 2*a, b* and *c* diagrammatically show, respectively, the top view, a side view and a cross-sectional view of a further embodiment of a connector for surface mounting provided with fixing elements according to the invention and mounted on a substrate.
Figure 2A:
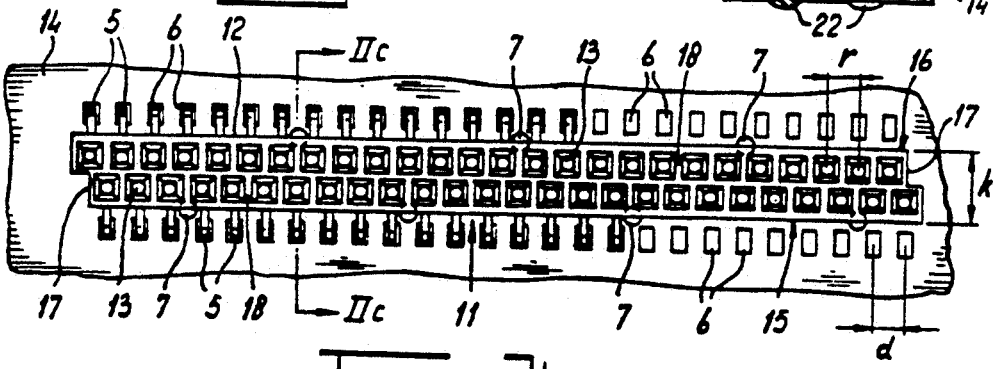

FIG. 2*a* shows the top view of a connector 11 provided with a housing 12 having contact elements 13 which are offset with respect to one another and are provided with connection ends 5 for connection by means of the surface mounting technique to connection areas 6 on a substrate 14. The substrate 14 is only shown partially. Extending from the long side walls 15, 16 of the housing 12 are pin-type fixing elements 7, in accordance with FIG. 1.

In this exemplary embodiment, the pitch distance r between the contact elements 13 situated adjoiningly in one row, the pitch distance k between the rows of contact elements 13 and the pitch distance d between the contact areas 6 of the substrate 14 are all 1.27 mm. The fixing elements 7 have a diameter of 0.8 mm and the openings 8 in the substrate have a diameter of 0.9 mm.

As can clearly be seen from FIG. 2*a*, the dense contact element packing of the connector 11 offers no space for disposing fixing elements of adequate mechanical strength, such as the pin-type fixing elements 7, within the circumference of the housing 12. Because the fixing elements 7 are sited at the long side walls 15, 16 of the housing 12, connectors 11 can be mounted adjoiningly on the substrate 14 at the short end faces 17 of the housing 12 without position loss.

Figure 2B:
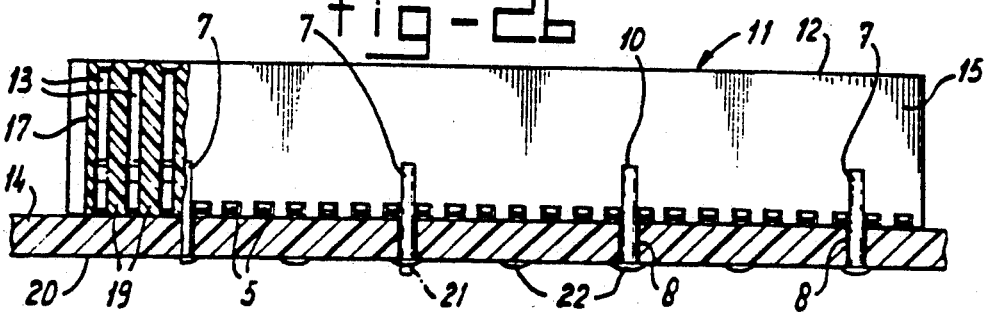

FIG. 2*b* shows the side view of the connector 11 mounted on the substrate 14, viewed towards the long side wall 15. A portion of the side wall 15 is shown broken away, as a result of which some of the contact elements 13 accommodated in the housing 12 are visible. The bottom wall of the housing 12, that is to say the portion of the housing 12 which rests on the substrate 14, is formed by the end faces 19 of the partitioning walls 18 situated between adjoining contact elements 13.

In this exemplary embodiment, the fixing elements 7 extend beyond the mounting side 19 of the housing 12 over a distance which is such that they project through the openings 8 at the side 20 of the substrate when the connector 11 is positioned on the substrate 14 as is shown by broken lines and reference numeral 21. The housing is fixed to the substrate by upsetting the projecting parts 21, as indicated by the reference numeral 22. In the case of a housing 12 consisting of plastic and also having fixing elements 7 manufactured from plastic, these can advantageously be upset ultrasonically. Of course, any thermal upsetting technique can be used per se for mounting the connector, provided the substrate 14 is not unacceptably thermally stressed thereby.

As can be seen in the cross-sectional view of FIG. 2*c* taken along the line II-c, the connection ends 5, which are resilient per se, of the contact elements 13 are held with a certain contact pressure against the connection areas 6 of the substrate 14 under the influence of the fixing elements 7. During the subsequent soldering process of the connector, this guarantees a reliable electrical contacting. As a consequence of this contact pressure, the connection ends 5 can also be connected by means of electrically conducting adhesive to the connection areas 6.

It is furthermore clear from FIG. 2*c* that the partitioning walls 18 have too small a thickness to support fixing elements of the dimensions such as the fixing elements 7.

Figure 3:
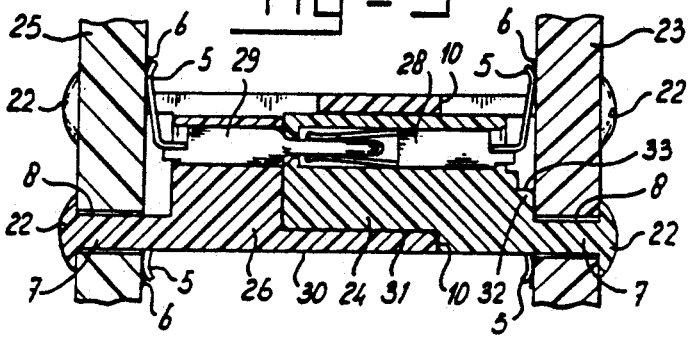
FIG. 3 diagrammatically shows a cross-sectional view of two connectors which contact one another, each mounted on a substrate and provided with fixing elements according to the invention.

FIG. 3 shows a cross-sectional view of a connector 24 mounted on a substrate 23 and a connector 26, connected thereto, mounted on a substrate 25. The connector 24 is provided with receiving contact elements 28, while the connector 26 is provided with pin contact elements 29.

It can be seen from FIG. 3 that the fixing elements 7 of the connector 26 extend in the longitudinal direction entirely over the respective side wall 30 of the housing of connector 26, while the fixing elements 7 of connector 24 extend only over a portion of the associated side wall 31 of the housing and form a stop 10 for the connector 26. The fixing elements 7 of the connector 24 also have a portion 33 displaced outwards from the face of the mounting side 32 as a spacing piece between the face of the substrate 23 on which the connector rests. By varying the thickness of this portion 33, it is possible to establish a particular contact pressure of the connection ends 5 of the contact elements on the corresponding connection area 6 of the substrate 23 if the same type of contact element is used.

Figure 4:
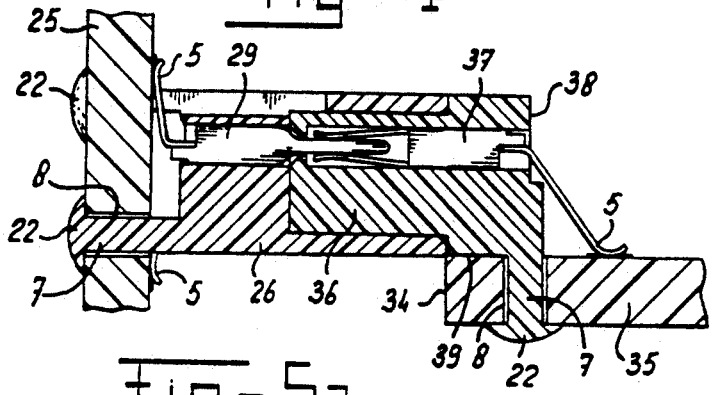
FIG. 4 diagrammatically shows a cross-sectional view of two further connectors which contact one another, each mounted on a substrate and provided with fixing elements according to the invention.

FIG. 4 shows a cross-sectional view of the connector 26 of FIG. 3 contacted by a further connector 36 disposed at the edge 34 of a substrate 35 and provided with receiving contact elements 37. The fixing element 7 of the connector 36 extends over a portion of the rear wall 38 from which the connection ends 5 of the contact elements 37 extend outwards. Apart from a greater mechanical rigidity of the fixing elements 7 as a consequence of their displaced disposition towards the rear wall 38 of the housing, the connector 36 can consequently also project far beyond the edge 34 of the substrate 35. Here again it is also true that the wall 39 is too thin at the mounting side of the housing in the case of connectors having, for example, a pitch distance of 1.27 mm to be able to support reliably fixing elements 7 of adequate thickness.

FIG. 5 shows various views of yet another embodiment of a connector 40 provided with fixing elements according to the invention, which connector is mounted on a substrate 46.

Figure 5A:
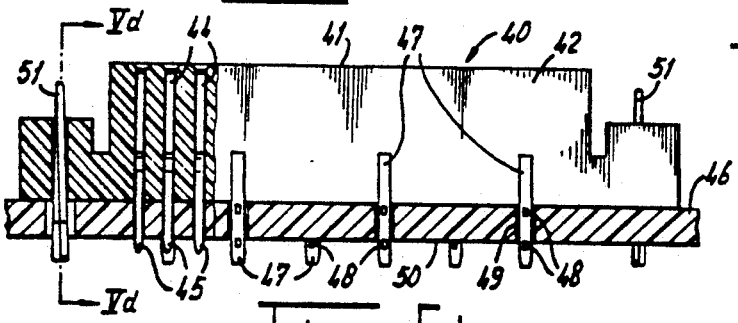
FIGS. 5*a, b, c* and *d* diagrammatically show, respectively, a side view, a top view and cross sections of yet a further embodiment of a connector provided with fixing elements according to the invention and mounted on a substrate.

FIG. 5*a* shows a partially cutaway side view towards a long side wall 42 of the housing 41 of the connector 40. In this embodiment, the contact elements 44 are provided with connection pins 45 for pin/hole mounting on the substrate 46. The fixing elements 47 have the shape of rectangular pins provided with elevations, projecting outwards at the circumference, in the form of protrusions and/or corrugations 48. These protrusions and/or corrugations 48 provide a self-locking fixing on the substrate by engaging in a clamping manner in the openings 49 intended for the purpose, and/or to the face 50 of the substrate 46.

Figure 5D:
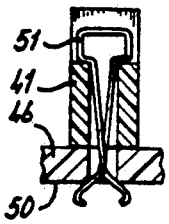
Figure 5B:
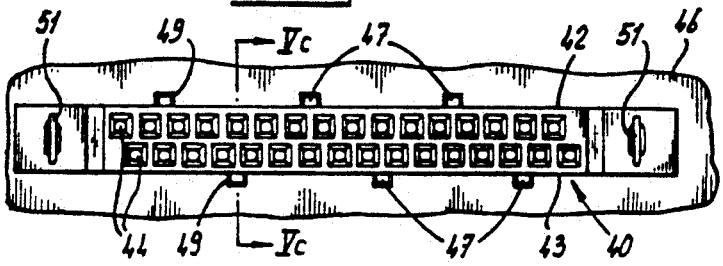

FIG. 5*b* shows the top view of the connector 40, that is to say from the side for accommodating a further connector.

Figure 5C:
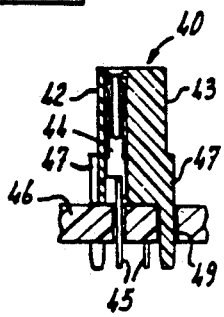

FIG. 5*c* shows a cross-sectional view of the connector 40 along the line V-c in FIG. 5*b*, while FIG. 5*d* shows a cross-sectional view along the line V-d in FIG. 5*a*, with additional fixing means 51 provided as an addition on the fixing elements 47 at the ends of the housing 41, as described in copending U.S. application Ser. No. 07/595,832 filed Oct. 11, 1990 and assigned to the assignee of the present application.

As a result of the mutually displaced positioning of the fixing elements 7 on the long side walls 15, 16 and of the associated openings 8 in the substrate as shown in FIGS. 2*a*, *b* (see also FIG. 1) a safeguard against incorrect positioning of the connector concerned on the substrate can be achieved. In this arrangement, a large number of unique patterns are conceivable both as regards the specific position of a particular fixing element 7 with respect to the housing of the connector and also the mutual position of the fixing elements 7 themselves. Apart from the round and rectangular shape shown of the fixing elements 7 and 47, respectively, a suitable shaping of the fixing elements themselves and the openings 8 and 49, respectively, in the substrate, if necessary in combination with different dimensions, can achieve a suitable safeguard against the undesired or incorrect mounting of particular connectors on a particular substrate. This is advantageous, in particular, in automatic assembly, where the fixing elements may also fulfil a sensing function, or to avoid errors during repair.

In a similar way, the fixing elements 7 and 44, respectively, can also be used as polarising elements 52 to prevent incorrect mutual contacting of connectors, as is indicated by broken lines in FIG. 1. The fixing element 7 concerned is in this case extended along the side wall 9 to the contact side 4 of the connector 1.

It will be clear that the invention is not limited to the embodiments shown or connectors having a particular pitch distance. If necessary, relatively thick fixing elements according to the invention can be formed at the ends of the connectors to provide a mechanically very rigid fixing of the connector concerned to a substrate.

I claim:

1. A connector having securing means for mounting to the surface of a circuit board comprising:

a housing of electrically insulating material, said housing having a plurality of walls which are oriented perpendicular to said circuit board, at least one of said walls having at least one mounting region disposed therein;

a plurality of electrical contacts projecting adjacent a bottom mounting surface of said housing for mounting in electrical contact with said circuit board; and wherein said securing means includes at least one mounting element formed at said mounting region in a manner such that a portion of said mounting element extends parallel to and projects outside the plane of said wall, said mounting element extending downward beyond the bottom mounting surface of the connector housing through a respective mounting hole in said circuit board.

2. A connector according to claim 1 wherein each said mounting element has protrusion or corrugations along a portion of its length which secures said element within the circuit board hole.

3. A connector according to claim 1 wherein each said mounting element has an enlarged end portion for securing the element at an opposite side of said circuit board.

4. A connector according to claim 3 wherein said mounting element is secured ultrasonically at said opposite side of said circuit board.

* * * * *